US008113292B2

(12) United States Patent
Huber et al.

(10) Patent No.: US 8,113,292 B2
(45) **Date of Patent: *Feb. 14, 2012**

(54) STROKABLE LINER HANGER AND METHOD

(75) Inventors: Kirk J. Huber, Magnolia, TX (US); Terry R. Bussear, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 161 days.

This patent is subject to a terminal disclaimer.

(21) Appl. No.: 12/335,107

(22) Filed: Dec. 15, 2008

(65) Prior Publication Data

US 2009/0283278 A1 Nov. 19, 2009

Related U.S. Application Data

(63) Continuation-in-part of application No. 12/175,747, filed on Jul. 18, 2008, now abandoned.

(51) Int. Cl.
*E21B 43/10* (2006.01)

(52) U.S. Cl. ..... 166/382; 166/208

(58) Field of Classification Search ..... 166/382, 166/387, 208

See application file for complete search history.

(56) References Cited

U.S. PATENT DOCUMENTS

| | | | |
|---|---|---|---|
| 1,362,552 | A | 12/1920 | Alexander et al. |
| 1,488,753 | A | 4/1924 | Kelly |
| 1,580,325 | A | 4/1926 | Leroy |
| 1,649,524 | A | 11/1927 | Hammond |
| 1,915,867 | A | 6/1933 | Penick |
| 1,984,741 | A | 12/1934 | Harrington |
| 2,089,477 | A | 8/1937 | Halbert |
| 2,119,563 | A | 6/1938 | Wells |
| 2,214,064 | A | 9/1940 | Niles |
| 2,257,523 | A | 9/1941 | Combs |
| 2,391,609 | A | 12/1945 | Wright |
| 2,412,841 | A | 12/1946 | Spangler |
| 2,762,437 | A | 9/1956 | Egan et al. |
| 2,804,926 | A | 9/1957 | Zublin |
| 2,810,352 | A | 10/1957 | Tumlison |
| 2,814,947 | A | 12/1957 | Stegemeier et al. |
| 2,942,668 | A | 6/1960 | Maly et al. |
| 2,945,541 | A | 7/1960 | Maly et al. |
| 3,103,789 | A | 9/1963 | McDuff |
| 3,216,503 | A | 11/1965 | Fisher et al. |

(Continued)

FOREIGN PATENT DOCUMENTS

| | | |
|---|---|---|
| CN | 1385594 | 12/2002 |

(Continued)

OTHER PUBLICATIONS

Restarick, Henry; "Horizontal Completion Options in Reservoirs With Sand Problems"; SPE29831; SPE Middle East Oil Show, Bahrain; Mar. 11-14, 1995; pp. 545-560.

(Continued)

*Primary Examiner* — David Andrews
(74) *Attorney, Agent, or Firm* — Cantor Colburn LLP

(57) ABSTRACT

A strokable liner hanger includes a liner hanger; one of a slide seal and a casing seal sub disposed adjacent the liner hanger and the other of the slide seal and the casing seal sub disposed adjacent the one of the slide seal and the casing seal sub. A method for completing a wellbore is included.

15 Claims, 6 Drawing Sheets

U.S. PATENT DOCUMENTS

| | | | | |
|---|---|---|---|---|
| 3,240,274 | A | | 3/1966 | Solum |
| 3,273,641 | A | | 9/1966 | Bourne |
| 3,302,408 | A | | 2/1967 | Schmid |
| 3,322,199 | A | | 5/1967 | Van Note, Jr. |
| 3,326,291 | A | | 6/1967 | Zandmer |
| 3,333,635 | A | | 8/1967 | Crawford |
| 3,385,367 | A | | 5/1968 | Kollsman |
| 3,386,508 | A | | 6/1968 | Bielstein et al. |
| 3,399,548 | A | * | 9/1968 | Burns ..... 464/18 |
| 3,419,089 | A | | 12/1968 | Venghiattis |
| 3,451,477 | A | | 6/1969 | Kelley |
| 3,468,375 | A | * | 9/1969 | States ..... 166/120 |
| RE27,252 | E | | 12/1971 | Sklar et al. |
| 3,675,714 | A | | 7/1972 | Thompson |
| 3,692,064 | A | | 9/1972 | Hohnerlein et al. |
| 3,739,845 | A | | 6/1973 | Berry et al. |
| 3,791,444 | A | | 2/1974 | Hickey |
| 3,876,471 | A | | 4/1975 | Jones |
| 3,918,523 | A | | 11/1975 | Stuber |
| 3,951,338 | A | | 4/1976 | Genna |
| 3,958,649 | A | | 5/1976 | Bull et al. |
| 3,975,651 | A | | 8/1976 | Griffiths |
| 4,153,757 | A | | 5/1979 | Clark, III |
| 4,173,255 | A | | 11/1979 | Kramer |
| 4,180,132 | A | | 12/1979 | Young |
| 4,186,100 | A | | 1/1980 | Mott |
| 4,187,909 | A | | 2/1980 | Erbstoesser |
| 4,245,701 | A | | 1/1981 | Chambers |
| 4,248,302 | A | | 2/1981 | Churchman |
| 4,250,907 | A | | 2/1981 | Struckman et al. |
| 4,257,650 | A | | 3/1981 | Allen |
| 4,265,485 | A | | 5/1981 | Boxerman et al. |
| 4,278,277 | A | | 7/1981 | Krijgsman |
| 4,283,088 | A | | 8/1981 | Tabakov et al. |
| 4,287,952 | A | | 9/1981 | Erbstoesser |
| 4,390,067 | A | | 6/1983 | Willman |
| 4,398,600 | A | * | 8/1983 | Vazquez ..... 166/206 |
| 4,398,898 | A | | 8/1983 | Odom |
| 4,410,216 | A | | 10/1983 | Allen |
| 4,415,205 | A | | 11/1983 | Rehm et al. |
| 4,434,849 | A | | 3/1984 | Allen |
| 4,463,988 | A | | 8/1984 | Bouck et al. |
| 4,484,641 | A | | 11/1984 | Dismukes |
| 4,491,186 | A | | 1/1985 | Alder |
| 4,497,714 | A | | 2/1985 | Harris |
| 4,512,403 | A | | 4/1985 | Santangelo et al. |
| 4,552,218 | A | | 11/1985 | Ross et al. |
| 4,552,230 | A | | 11/1985 | Anderson et al. |
| 4,572,295 | A | | 2/1986 | Walley |
| 4,576,404 | A | | 3/1986 | Weber |
| 4,577,691 | A | | 3/1986 | Huang et al. |
| 4,614,303 | A | | 9/1986 | Moseley, Jr. et al. |
| 4,649,996 | A | | 3/1987 | Kojicic et al. |
| 4,817,710 | A | | 4/1989 | Edwards et al. |
| 4,821,800 | A | | 4/1989 | Scott et al. |
| 4,856,590 | A | | 8/1989 | Caillier |
| 4,899,835 | A | | 2/1990 | Cherrington |
| 4,917,183 | A | | 4/1990 | Gaidry et al. |
| 4,944,349 | A | | 7/1990 | Von Gonten, Jr. |
| 4,974,674 | A | | 12/1990 | Wells |
| 4,997,037 | A | | 3/1991 | Coston |
| 4,998,585 | A | | 3/1991 | Newcomer et al. |
| 5,004,049 | A | | 4/1991 | Arterbury |
| 5,016,710 | A | | 5/1991 | Renard et al. |
| 5,040,283 | A | | 8/1991 | Pelgrom |
| 5,060,737 | A | | 10/1991 | Mohn |
| 5,107,927 | A | | 4/1992 | Whiteley et al. |
| 5,132,903 | A | | 7/1992 | Sinclair |
| 5,156,811 | A | | 10/1992 | White |
| 5,188,191 | A | | 2/1993 | Tomek |
| 5,217,076 | A | | 6/1993 | Masek |
| 5,333,684 | A | | 8/1994 | Walter et al. |
| 5,337,821 | A | | 8/1994 | Peterson |
| 5,339,895 | A | | 8/1994 | Arterbury et al. |
| 5,339,897 | A | | 8/1994 | Leaute |
| 5,355,956 | A | | 10/1994 | Restarick |
| 5,377,750 | A | | 1/1995 | Arterbury et al. |
| 5,381,864 | A | | 1/1995 | Nguyen et al. |
| 5,384,046 | A | | 1/1995 | Lotter et al. |
| 5,431,346 | A | | 7/1995 | Sinaisky |
| 5,435,393 | A | | 7/1995 | Brekke et al. |
| 5,435,395 | A | | 7/1995 | Connell |
| 5,439,966 | A | | 8/1995 | Graham et al. |
| 5,511,616 | A | | 4/1996 | Bert |
| 5,551,513 | A | | 9/1996 | Surles et al. |
| 5,586,213 | A | | 12/1996 | Bridges et al. |
| 5,597,042 | A | | 1/1997 | Tubel et al. |
| 5,609,204 | A | | 3/1997 | Rebardi et al. |
| 5,673,751 | A | | 10/1997 | Head et al. |
| 5,803,179 | A | | 9/1998 | Echols et al. |
| 5,829,520 | A | | 11/1998 | Johnson |
| 5,831,156 | A | | 11/1998 | Mullins |
| 5,839,508 | A | | 11/1998 | Tubel et al. |
| 5,873,410 | A | | 2/1999 | Iato et al. |
| 5,881,809 | A | | 3/1999 | Gillespie et al. |
| 5,896,928 | A | | 4/1999 | Coon |
| 5,944,446 | A | | 8/1999 | Hocking |
| 5,982,801 | A | | 11/1999 | Deak |
| 6,044,869 | A | | 4/2000 | Koob |
| 6,068,015 | A | | 5/2000 | Pringle |
| 6,098,020 | A | | 8/2000 | Den Boer |
| 6,112,815 | A | | 9/2000 | Boe et al. |
| 6,112,817 | A | | 9/2000 | Voll et al. |
| 6,119,780 | A | | 9/2000 | Christmas |
| 6,228,812 | B1 | | 5/2001 | Dawson et al. |
| 6,253,847 | B1 | | 7/2001 | Stephenson |
| 6,253,861 | B1 | | 7/2001 | Carmichael et al. |
| 6,273,194 | B1 | | 8/2001 | Hiron et al. |
| 6,301,959 | B1 | | 10/2001 | Hrametz et al. |
| 6,305,470 | B1 | | 10/2001 | Woie |
| 6,325,152 | B1 | | 12/2001 | Kelley et al. |
| 6,338,363 | B1 | | 1/2002 | Chen et al. |
| 6,367,547 | B1 | | 4/2002 | Towers et al. |
| 6,371,210 | B1 | | 4/2002 | Bode et al. |
| 6,372,678 | B1 | | 4/2002 | Youngman et al. |
| 6,419,021 | B1 | | 7/2002 | George et al. |
| 6,474,413 | B1 | | 11/2002 | Barbosa et al. |
| 6,505,682 | B2 | | 1/2003 | Brockman |
| 6,516,888 | B1 | | 2/2003 | Gunnarson et al. |
| 6,530,431 | B1 | | 3/2003 | Castano-Mears et al. |
| 6,561,732 | B1 | | 5/2003 | Bloomfield et al. |
| 6,581,681 | B1 | | 6/2003 | Zimmerman et al. |
| 6,581,682 | B1 | | 6/2003 | Parent et al. |
| 6,622,794 | B2 | | 9/2003 | Zisk, Jr. |
| 6,632,527 | B1 | | 10/2003 | McDaniel et al. |
| 6,635,732 | B2 | | 10/2003 | Mentak |
| 6,667,029 | B2 | | 12/2003 | Zhong et al. |
| 6,679,324 | B2 | | 1/2004 | Den Boer et al. |
| 6,692,766 | B1 | | 2/2004 | Rubinstein et al. |
| 6,699,503 | B1 | | 3/2004 | Sako et al. |
| 6,699,611 | B2 | | 3/2004 | Kim et al. |
| 6,712,154 | B2 | | 3/2004 | Cook et al. |
| 6,722,437 | B2 | | 4/2004 | Vercaemer et al. |
| 6,786,285 | B2 | | 9/2004 | Johnson et al. |
| 6,817,416 | B2 | | 11/2004 | Wilson et al. |
| 6,820,690 | B2 | | 11/2004 | Vercaemer et al. |
| 6,830,104 | B2 | | 12/2004 | Nguyen et al. |
| 6,831,044 | B2 | | 12/2004 | Constien |
| 6,840,321 | B2 | | 1/2005 | Restarick et al. |
| 6,857,476 | B2 | | 2/2005 | Richards |
| 6,863,126 | B2 | | 3/2005 | McGlothen et al. |
| 6,896,049 | B2 | | 5/2005 | Moyes |
| 6,913,079 | B2 | | 7/2005 | Tubel |
| 6,938,698 | B2 | | 9/2005 | Coronado |
| 6,951,252 | B2 | | 10/2005 | Restarick et al. |
| 6,959,764 | B2 | | 11/2005 | Preston |
| 6,976,542 | B2 | | 12/2005 | Henriksen et al. |
| 7,011,076 | B1 | | 3/2006 | Weldon et al. |
| 7,032,675 | B2 | | 4/2006 | Steele et al. |
| 7,059,410 | B2 | | 6/2006 | Bousche et al. |
| 7,084,094 | B2 | | 8/2006 | Gunn et al. |
| 7,159,656 | B2 | | 1/2007 | Eoff et al. |
| 7,185,706 | B2 | | 3/2007 | Freyer |
| 7,207,385 | B2 | | 4/2007 | Smith et al. |
| 7,252,162 | B2 | | 8/2007 | Akinlade et al. |
| 7,258,166 | B2 | | 8/2007 | Russell |
| 7,290,606 | B2 | | 11/2007 | Coronado et al. |

| | | | |
|---|---|---|---|
| 7,290,610 | B2 | 11/2007 | Corbett et al. |
| 7,318,472 | B2 | 1/2008 | Smith |
| 7,322,412 | B2 | 1/2008 | Badalamenti et al. |
| 7,325,616 | B2 | 2/2008 | Lopez de Cardenas et al. |
| 7,360,593 | B2 | 4/2008 | Constien |
| 7,367,399 | B2 | 5/2008 | Steele et al. |
| 7,395,858 | B2 | 7/2008 | Barbosa et al. |
| 7,398,822 | B2 | 7/2008 | Meijer et al. |
| 7,409,999 | B2 | 8/2008 | Henriksen et al. |
| 7,413,022 | B2 | 8/2008 | Broome et al. |
| 7,451,814 | B2 | 11/2008 | Graham et al. |
| 7,469,743 | B2 | 12/2008 | Richards |
| 7,581,593 | B2 | 9/2009 | Pankratz et al. |
| 7,621,326 | B2 | 11/2009 | Crichlow |
| 7,644,854 | B1 | 1/2010 | Holmes et al. |
| 7,647,966 | B2 | 1/2010 | Cavender et al. |
| 7,673,678 | B2 | 3/2010 | MacDougall et al. |
| 7,757,757 | B1 | 7/2010 | Vroblesky |
| 2002/0020527 | A1 | 2/2002 | Kilaas |
| 2002/0125009 | A1 | 9/2002 | Wetzel et al. |
| 2002/0148610 | A1 | 10/2002 | Bussear et al. |
| 2002/0170717 | A1 | 11/2002 | Venning et al. |
| 2003/0221834 | A1 | 12/2003 | Hess et al. |
| 2004/0052689 | A1 | 3/2004 | Yao |
| 2004/0060705 | A1 | 4/2004 | Kelley |
| 2004/0094307 | A1 | 5/2004 | Daling et al. |
| 2004/0144544 | A1 | 7/2004 | Freyer |
| 2004/0159447 | A1 | 8/2004 | Bissonnette et al. |
| 2004/0194971 | A1 | 10/2004 | Thomson |
| 2004/0244988 | A1 | 12/2004 | Preston |
| 2005/0016732 | A1 | 1/2005 | Brannon et al. |
| 2005/0086807 | A1 | 4/2005 | Richard et al. |
| 2005/0126776 | A1 | 6/2005 | Russell |
| 2005/0178705 | A1 | 8/2005 | Broyles et al. |
| 2005/0189119 | A1 | 9/2005 | Gynz-Rekowski |
| 2005/0199298 | A1 | 9/2005 | Farrington |
| 2005/0207279 | A1 | 9/2005 | Chemali et al. |
| 2005/0241835 | A1 | 11/2005 | Burris et al. |
| 2005/0274515 | A1 | 12/2005 | Smith et al. |
| 2006/0032630 | A1 | 2/2006 | Heins |
| 2006/0042798 | A1 | 3/2006 | Badalamenti et al. |
| 2006/0048936 | A1 | 3/2006 | Fripp et al. |
| 2006/0048942 | A1 | 3/2006 | Moen et al. |
| 2006/0076150 | A1 | 4/2006 | Coronado et al. |
| 2006/0086498 | A1 | 4/2006 | Wetzel et al. |
| 2006/0108114 | A1 | 5/2006 | Johnson |
| 2006/0118296 | A1 | 6/2006 | Dybevik et al. |
| 2006/0124360 | A1 | 6/2006 | Lee et al. |
| 2006/0157242 | A1 | 7/2006 | Graham et al. |
| 2006/0175065 | A1 | 8/2006 | Ross |
| 2006/0185849 | A1 | 8/2006 | Edwards et al. |
| 2006/0250274 | A1 | 11/2006 | Mombourquette et al. |
| 2006/0272814 | A1 | 12/2006 | Broome et al. |
| 2006/0273876 | A1 | 12/2006 | Pachla et al. |
| 2007/0012444 | A1 | 1/2007 | Horgan et al. |
| 2007/0039741 | A1 | 2/2007 | Hailey, Jr. |
| 2007/0044962 | A1 | 3/2007 | Tibbles |
| 2007/0045266 | A1 | 3/2007 | Sandberg et al. |
| 2007/0056729 | A1 | 3/2007 | Pankratz et al. |
| 2007/0131434 | A1 | 6/2007 | MacDougall et al. |
| 2007/0181299 | A1 | 8/2007 | Chung et al. |
| 2007/0209799 | A1 | 9/2007 | Vinegar et al. |
| 2007/0246210 | A1 | 10/2007 | Richards |
| 2007/0246213 | A1 | 10/2007 | Hailey, Jr. |
| 2007/0246225 | A1 | 10/2007 | Hailey, Jr. et al. |
| 2007/0246407 | A1 | 10/2007 | Richards et al. |
| 2007/0272408 | A1 | 11/2007 | Zazovsky et al. |
| 2007/0289749 | A1 | 12/2007 | Wood et al. |
| 2008/0035349 | A1 | 2/2008 | Richard |
| 2008/0035350 | A1 | 2/2008 | Henriksen et al. |
| 2008/0053662 | A1 | 3/2008 | Williamson et al. |
| 2008/0135249 | A1 | 6/2008 | Fripp et al. |
| 2008/0149323 | A1 | 6/2008 | O'Malley et al. |
| 2008/0149351 | A1 | 6/2008 | Marya et al. |
| 2008/0169099 | A1 | 7/2008 | Pensgaard |
| 2008/0236839 | A1 | 10/2008 | Oddie |
| 2008/0236843 | A1 | 10/2008 | Scott et al. |
| 2008/0251255 | A1 | 10/2008 | Forbes et al. |
| 2008/0283238 | A1 | 11/2008 | Richards et al. |
| 2008/0296023 | A1 | 12/2008 | Willauer |
| 2008/0314590 | A1 | 12/2008 | Patel |
| 2009/0056816 | A1 | 3/2009 | Arov et al. |
| 2009/0057014 | A1 | 3/2009 | Richard et al. |
| 2009/0071646 | A1 | 3/2009 | Pankratz et al. |
| 2009/0101330 | A1 | 4/2009 | Johnson |
| 2009/0101342 | A1 | 4/2009 | Gaudette et al. |
| 2009/0133869 | A1 | 5/2009 | Clem |
| 2009/0133874 | A1 | 5/2009 | Dale et al. |
| 2009/0139717 | A1 | 6/2009 | Richard et al. |
| 2009/0139727 | A1 | 6/2009 | Tanju et al. |
| 2009/0194282 | A1 | 8/2009 | Beer et al. |
| 2009/0205834 | A1 | 8/2009 | Garcia et al. |
| 2009/0283255 | A1* | 11/2009 | Huber et al. ..... 166/208 |
| 2009/0301704 | A1 | 12/2009 | Dillett et al. |
| 2010/0126720 | A1 | 5/2010 | Kaiser et al. |

FOREIGN PATENT DOCUMENTS

| | | | |
|---|---|---|---|
| GB | 1492345 | | 6/1976 |
| GB | 2341405 | | 3/2000 |
| JP | 59089383 | | 5/1984 |
| SU | 1335677 | | 8/1985 |
| WO | 9403743 | | 2/1994 |
| WO | 0079097 | | 12/2000 |
| WO | 0165063 | | 9/2001 |
| WO | 0177485 | | 10/2001 |
| WO | WO0192681 | A1 | 12/2001 |
| WO | 02075110 | | 9/2002 |
| WO | 2004018833 | A1 | 3/2004 |
| WO | 2006015277 | | 2/2006 |
| WO | 2008092241 | A1 | 8/2008 |

OTHER PUBLICATIONS

Richard, Bennett M., et al.; U.S. Appl. No. 11/949,403; "Multi-Position Valves for Fracturing and Sand Control and Associated Completion Methods"; Filed in the United States Patent and Trademark Office Dec. 3, 2007. Specification Having 13 Pages And Drawings Having 11 Sheets.

An Oil Selective Inflow Control System; Rune Freyer, Easy Well Solutions: Morten Fejerskkov, Norsk Hydro; Arve Huse, Altinex; European Petroleum Conference, Oct. 29-31, Aberdeen, United Kingdom, Copyright 2002, Society of Petroleum Engineers, Inc. [Abstract Only].

Baker Hughes, Thru-Tubing Intervention, Z-Seal Technology, Z-Seal Metal-to-Metal Sealing Technology Shifts the Paradigm,http://www.bakerhughes.com/assets/media/brochures/4d121c2bfa7e1c7c9c00001b/file/30574t-ttintervention_catalog-1110.pdf.pdf&fs=4460520, 2010 pp. 79-81.

Baker Oil Tools, Product Report, Sand Control Systems: Screens, Equalizer CF Product Family No. H48688. Nov. 2005. 1 page.

Notification of Transmittal of the International Search Report and the Written Opinion of the International Searching Authority; PCT Application No. PCT/US2010/034747; Mailed Dec. 13, 2010; Korean Intellectualy Property Office.

Bercegeay, E. P., et al. "A One-Trip Gravel Packing System," SPE 4771, New Orleans, Louisiana, Feb. 7-8, 1974. 12 pages.

Burkill, et al. Selective Steam Injection in Open hole Gravel-packed Liner Completions SPE 5958.

Concentric Annular Pack Screen (CAPS) Service; Retrieved From Internet on Jun. 18, 2008. http://www.halliburton.com/ps/Default.aspx?navid=81&pageid=273&prodid=PRN%3a%3alQSHFJ2QK.

Determination of Perforation Schemes to Control Production and Injection Profiles Along Horizontal; Asheim, Harald, Norwegian Institute of Technology; Oudeman, Pier, Koninklijke/Shell Exploratie en Producktie Laboratorium; SPE Drilling and Completion, vol. 12, No. 1, March; pp. 13-18; 1997 Society of Petroleum Engieneers.

Dikken, Ben J., SPE, Koninklijke/Shell E&P Laboratorium; "Pressure Drop in Horizontal Wells and Its Effect on Production Performance"; Nov. 1990, JPT; Copyright 1990, Society of Petroleum Engineers; pp. 1426-1433.

Dinarvand. R., D'Emanuele, A (1995) The use of thermoresponsive hydrogels for on-off release of molecules, J. Control. Rel. 36 221-227.

E.L. Joly, et al. New Production Logging Technique for Horizontal Wells. SPE 14463 1988.
Hackworth, et al. "Development and First Application of Bistable Expandable Sand Screen," Society of Petroleum Engineers: SPE 84265. Oct. 5-8, 2003. 14 pages.
Henry Restarick, "Horizontal Completion Options in Reservoirs with Sand Problems". SPE 29831. Mar. 11-14, 1995. pp. 545-560.
Ishihara, K., Hamada, N., Sato, S., Shinohara, I., (1984) Photoinduced swelling control of amphiphdilic azoaromatic polymer membrane. J. Polym. Sci., Polm. Chem. Ed. 22: 121-128.
Mackenzie, Gordon adn Garfield, Garry, Baker Oil Tools, Wellbore Isolation Intervention Devices Utilizing a Metal-to-Metal Rather Than an Elastomeric Sealing Methodology, SPE 109791, Society of Petroleum Engineers, Presentation at the 2007 SPE Annual Technical Conference and Exhibition held in Anaheim, California, U.S.A., Nov. 11-14, 2007, pp. 1-5.
Mathis, Stephen P. "Sand Management: A Review of Approaches and Conerns, " SPE 82240, The Hague, The Netherlands, May 13-14, 2003. 7 pages.
Optimization of Commingled Production Using Infinitely Variable Inflow Control Valves; M.M, J.J. Naus, Delft University of Technology (DUT), Shell International Exploration and production (SIEP); J.D. Jansen, DUT and SIEP; SPE Annual Technical Conference and Exhibtion, Sep. 26-29 Houston, Texas, 2004, Society of Patent Engineers.
Pardo, et al. "Completion, Techniques Used in Horizontal Wells Drilled in Shallow Gas Sands in the Gulf of Mexio". SPE 24842. Oct. 4-7, 1992.
International Search Report and Written Opinion; Date of Mailing Jan. 13, 2011; International Appln No. PCT/US2010/034750; International Search Report 5 pages; Written Opinion 3 pages.
International Search Report; Date of Mailing Jan. 27, 2011; International Application No. PCT/US2010/034752; 3 pages.
International Search Report and Written Opinion; Date of Mailing Jan. 27, 2011, International Appln No. PCT/US2010/034758; International Search Report 10 pages; Written Opinion 3 pages.
R. D. Harrison Jr., et al. Case Histories: New Horizontal Completion Designs Facilitate Development and Increase Production Capabilites in Sandstone Reservoirs. SPE 27890. Wester Regional Meeting held in Long Beach, CA Mar. 23-25, 1994.
"Rapid Swelling and Deswelling of Thermoreversible Hydrophobically Modified Poly (N-Isopropylacrylamide) Hydrogels Prepared by freezing Polymerisation", Xue, W., Hamley, I.W. and Huglin, M.B., 2002, 43(1) 5181-5186.
International Search Report and Written Opinion, Mailed Feb. 2, 2010, International Appln. No. PCT/US2009/049661, Written Opinion 7 pages, International Search Report 3 pages.
Tanaka, T., Nishio, I., Sun, S.T., Uena-Nisho, S. (1982) Collapse of gels in an electric field, Science, 218-467-469.
Tanaka, T., Ricka, J., (1984) Swelling of Ionic gels: Quantitative performance of the Donnan Thory, Macromolecules, 17, 2916-2921.
"Thermoreversible Swelling Behavior of Hydrogels Based on N-Isopropylacrylamide with a Zwitterionic Comonomer". Xue, W., Champ, S. and Huglin, M.B. 2001, European Polymer Journal, 37(5) 869-875.

* cited by examiner

STROKABLE LINER HANGER AND METHOD

CROSS REFERENCE TO RELATED APPLICATION

The present application is a continuation-in-part of United States Non Provisional application Ser. No. 12/175,747, filed on Jul. 18, 2008 now abandoned, the entire contents of which are specifically incorporated herein by reference.

BACKGROUND

Liner hangers are common in the hydrocarbon recovery industry and come in a number of sizes, shapes, and operational configurations. Each of these works well for its intended purpose but each also has drawbacks. Sometimes the drawbacks can become problematic and this is especially so when the hangers are used in applications for which they were not originally designed or when the environment of use changes due to changing landscape surrounding the industry as a hole. Often, liner hangers utilize a packer to act as a seal for the liner top. In some embodiments more than one packer is used for a single liner hanger arrangement.

SUMMARY

A strokable liner hanger including a liner hanger; one of a slide seal and a casing seal sub disposed adjacent the liner hanger; the other of the slide seal and the casing seal sub disposed adjacent the one of the slide seal and the casing seal sub.

A method for completing a wellbore with a strokable liner hanger arrangement including running a liner hanger having one of a slide seal and a casing seal sub disposed adjacent the liner hanger, the other of the slide seal and the casing seal sub disposed adjacent the one of the slide seal and the casing seal sub to a target depth in a casing engaging the liner hanger with the casing.

BRIEF DESCRIPTION OF THE DRAWINGS

Referring now to the drawings wherein like elements are numbered alike in the several Figures.

DETAILED DESCRIPTION

Figure 1:
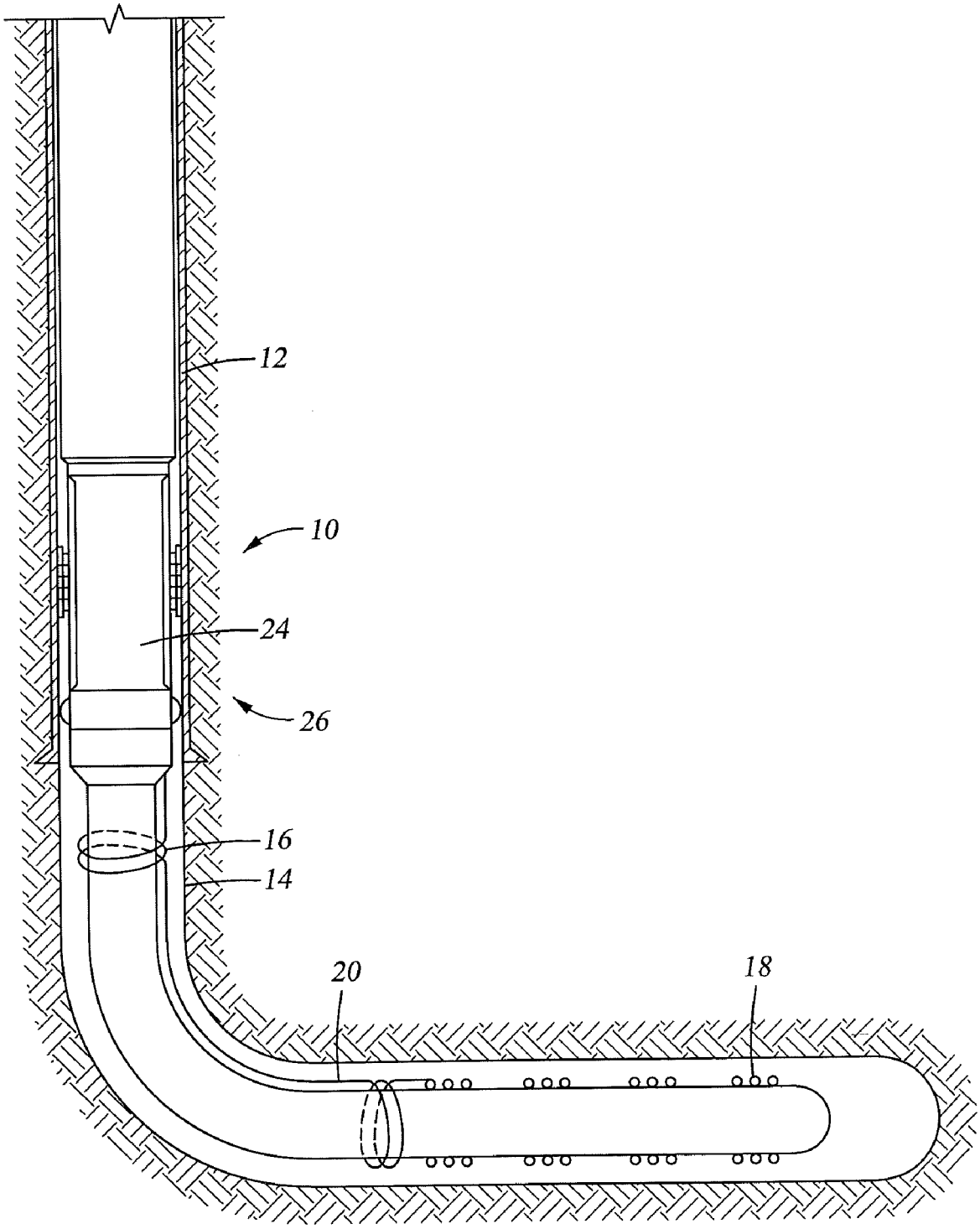
FIG. 1 is a schematic representation of a strokable liner hanger system as disclosed herein.

Referring to FIG. 1, a portion of a wellbore 10 is illustrated comprising a production casing 12 and an open hole 14 extending therefrom. A liner 16 is represented schematically including one or more inflow control devices/screens 18 and one or more control and or monitoring lines 20.

A liner hanger arrangement is required to locate the liner properly. The inventor hereof has discovered that although liner hangers of the prior art are billed as seals, they do not function as such particularly in wells that have very high temperature gradients. This is particularly true in Steam Assisted Gravity Drainage (SAGD) wells due to the extremely high temperatures the steam brings to the liner 16. With the heat comes a substantial amount of thermal expansion of the liner. Because the liner is significantly more exposed to the heat than the production casing, the thermal expansion of the liner is correspondingly greater. This causes movement at the liner production casing juncture that movement being experienced directly between the production casing 12 and a liner hanger 24. Movement is necessary between these components of the well because the thermal expansions of the liner 16 and the production casing 12 are different but the same movement causes problems with respect to sealing of the liner hanger 24 to the casing 12.

To address the foregoing, a strokable liner hanger arrangement 26 is disclosed that allows for the movement of relative thermal expansion while maintaining a reliable seal between the production casing 12 and the liner hanger 24. Several alternate embodiments as illustrated in FIGS. 2-8 and described hereunder allow for longitudinal movement of the liner hanger 24 while maintaining a sealed condition with, ultimately, the casing 12. The precise dimensions of the polished bore, whether on the liner hanger 24 or the casing 12, is selected for the specific application taking into account the anticipated thermal expansion likely to be experienced.

Figure 2:
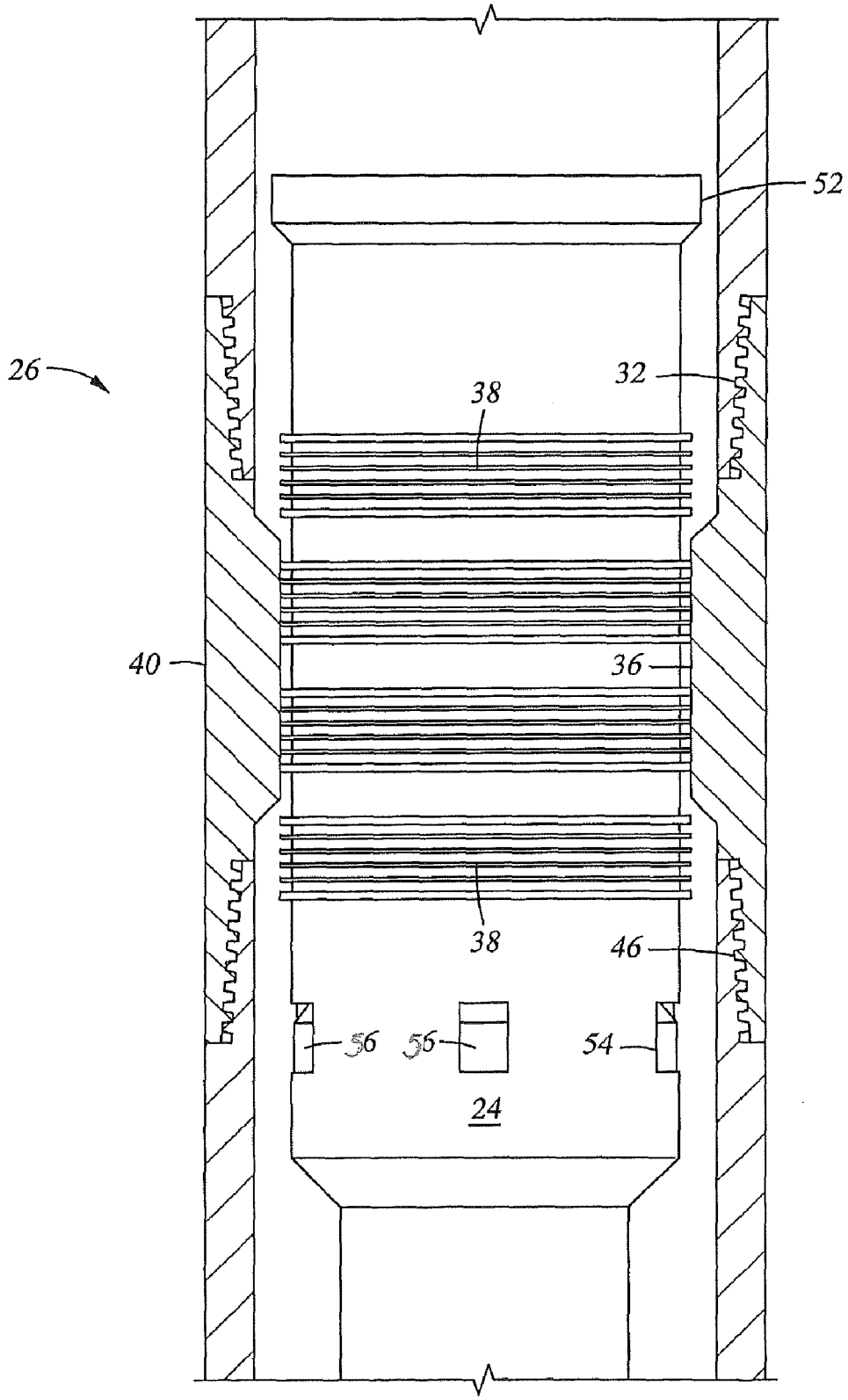
FIG. 2 is a schematic view of one embodiment of an arrangement as disclosed herein.
Figure 3:
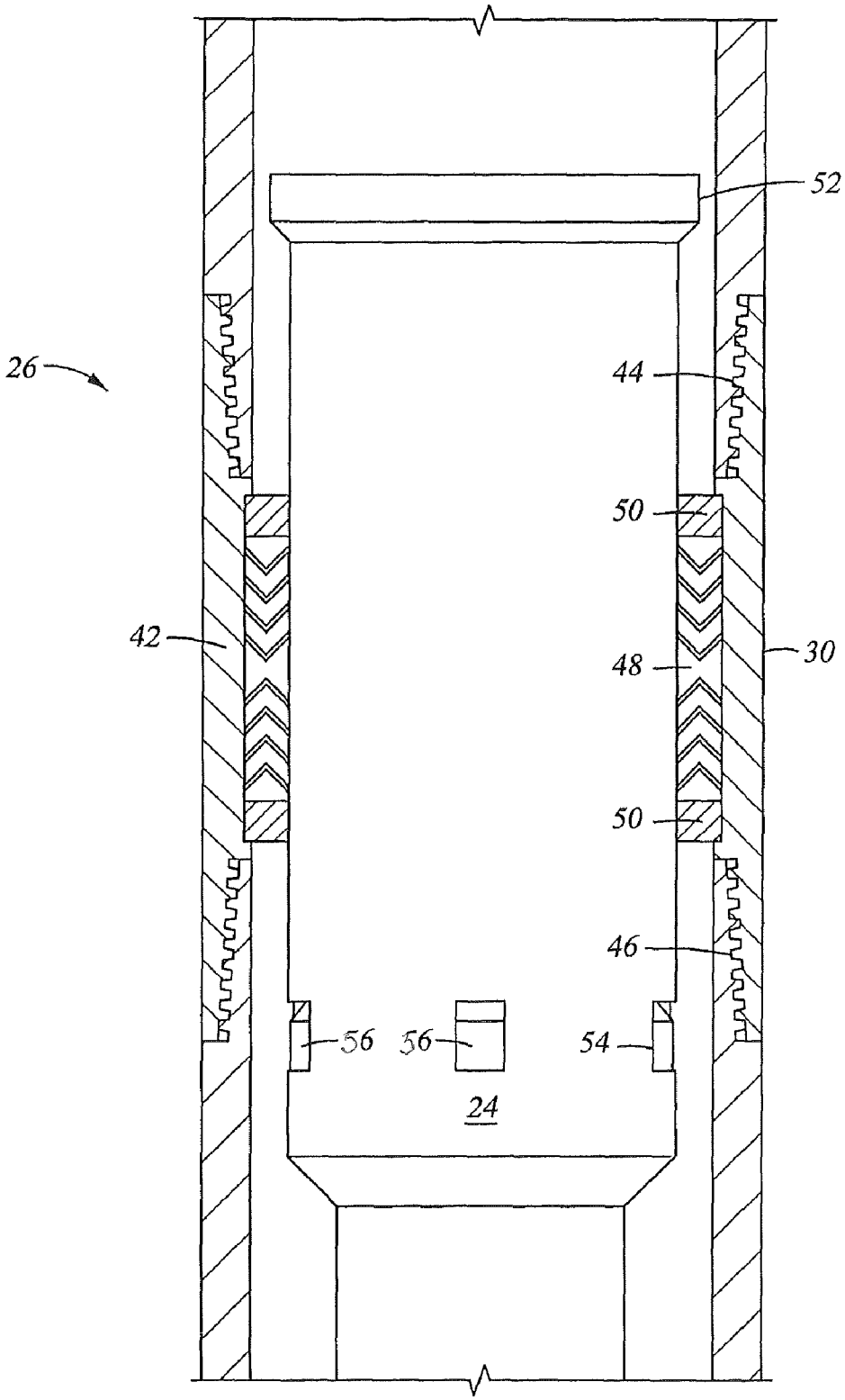
FIG. 3 is a schematic view of another embodiment of an arrangement as disclosed herein.

Referring to FIGS. 2 and 3 two related but reversed configurations are illustrated. In FIG. 2, the production casing 12 (note FIG. 1) includes a collar 30. The collar 30 has at least a thread 32 to connect to the casing 12 and may include a thread 34 to connect to more downhole disposed structure (not shown). In this embodiment the collar 30 provides a polished bore 36 against which one or more seals 38 at an outside surface 40 of the liner hanger 24. In the reverse configuration of FIG. 3, a collar 42 having at least thread 44 and optionally thread 46 provides a seal 48 that may be configured as a seal stack as shown or may be other conventional seal configurations. In the particularly illustrated embodiment of FIG. 3, wiper rings 50 are also illustrated but it is to be understood that the use of the rings 50 is optional.

In both of the embodiments illustrated in FIGS. 2 and 3, the arrangement 26 will include a no go feature 52 at an uphole end of the liner hanger 24 that may be fixed and further will include a downhole no go feature 54 that is retractable and extendible. In these embodiments the downhole no go features 54 must be retractable in order to be able to pass through the polished bore (FIG. 2) or the seal stack (FIG. 3). In order for the no go 54 to have effect however, it must also be extendible. In each of FIGS. 2 and 3, the no go feature is illustrated as one or more dogs 56. For clarity the dogs in FIG. 2 are illustrated extended and in FIG. 3 are illustrated retracted. An exemplary system capable of retracting and extending one or more dogs is commercially available from Baker Oil Tools Houston Tex. under product family number 836-02.

Figure 4:
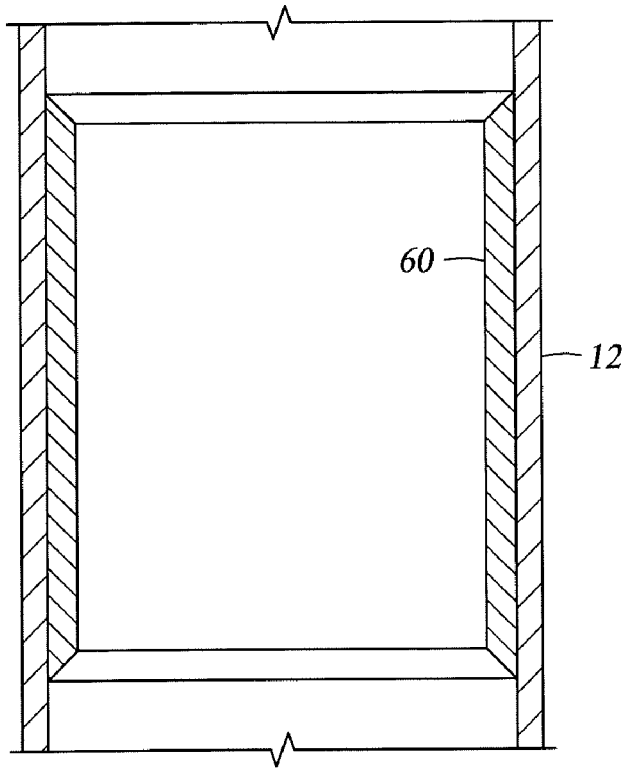
FIG. 4 is a schematic view of another embodiment of an arrangement as disclosed herein.
Figure 5:
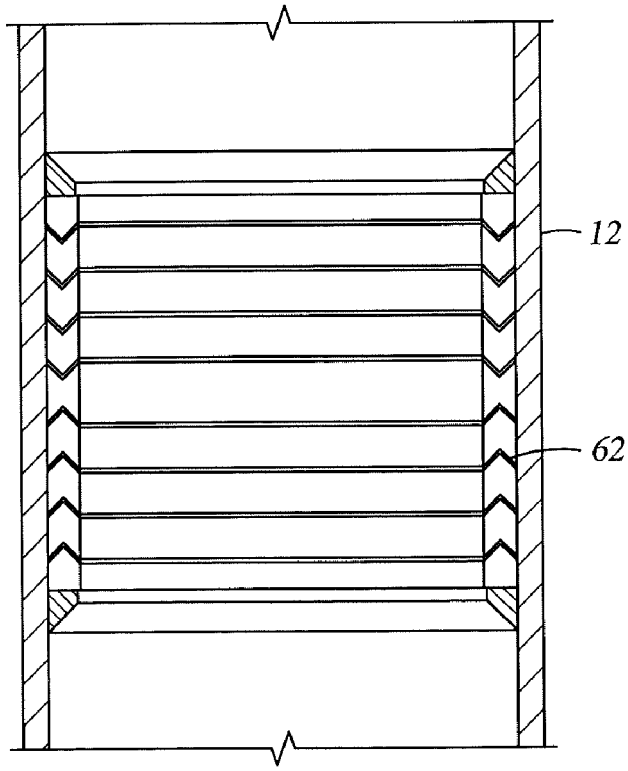
FIG. 5 is a schematic view of another embodiment of an arrangement as disclosed herein.

Referring to FIGS. 4 and 5, a very similar configuration is illustrated in a very schematic way to simplify understanding of the distinction. In these figures, rather than a collar, the polished bore 60 or the seal 62 are inserts in the casing string 12. In other respects these embodiments are similar to those of FIGS. 2 and 3. In the embodiments of FIG. 4 and 5 a separate sub is avoided.

Figure 6:
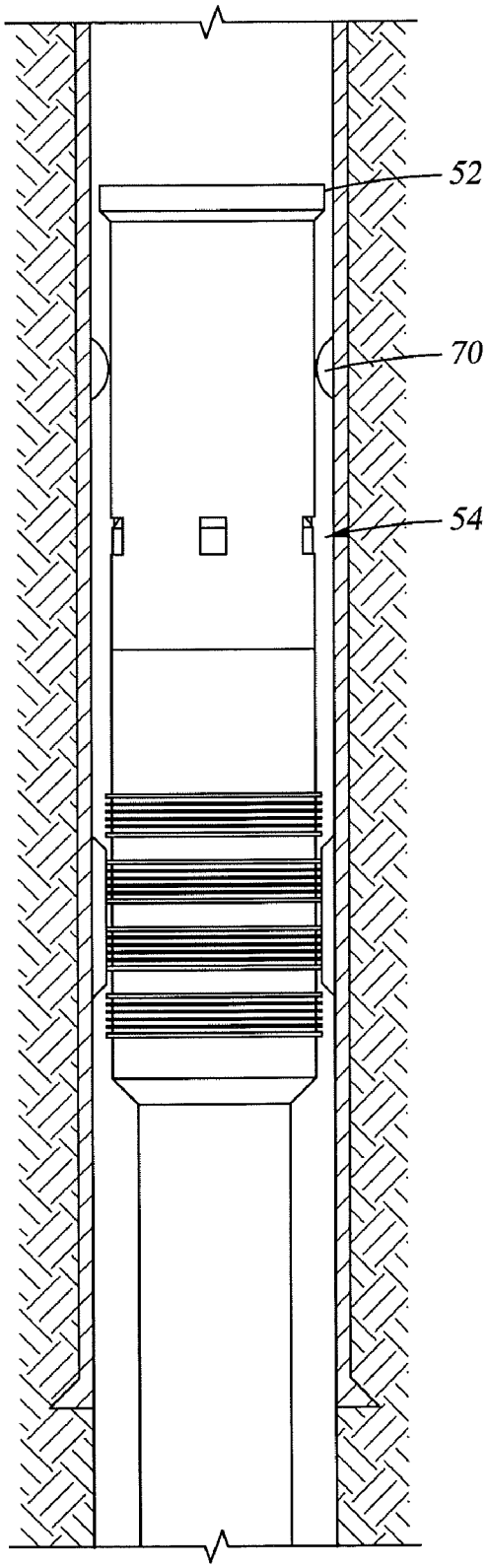
FIG. 6 is a schematic view of another embodiment of an arrangement as disclosed herein.

Referring now to FIG. 6, another embodiment of a strokable liner hanger arrangement is illustrated having a casing mounted no go land 70 that functions in use to provide a positive land for both the uphole no go feature 52 and the downhole no go feature 54. It is to be recognized also that the uphole and downhole no gos are both located uphole of the seal or polished bore. A consideration for utilizing this configuration is the length of tubing between the no go 52 and the no go 54 to ensure that the stroke of the arrangement 26 is not in excess of the capability of the seal or polished bore to provide a seal against the arrangement 26.

Figure 7:
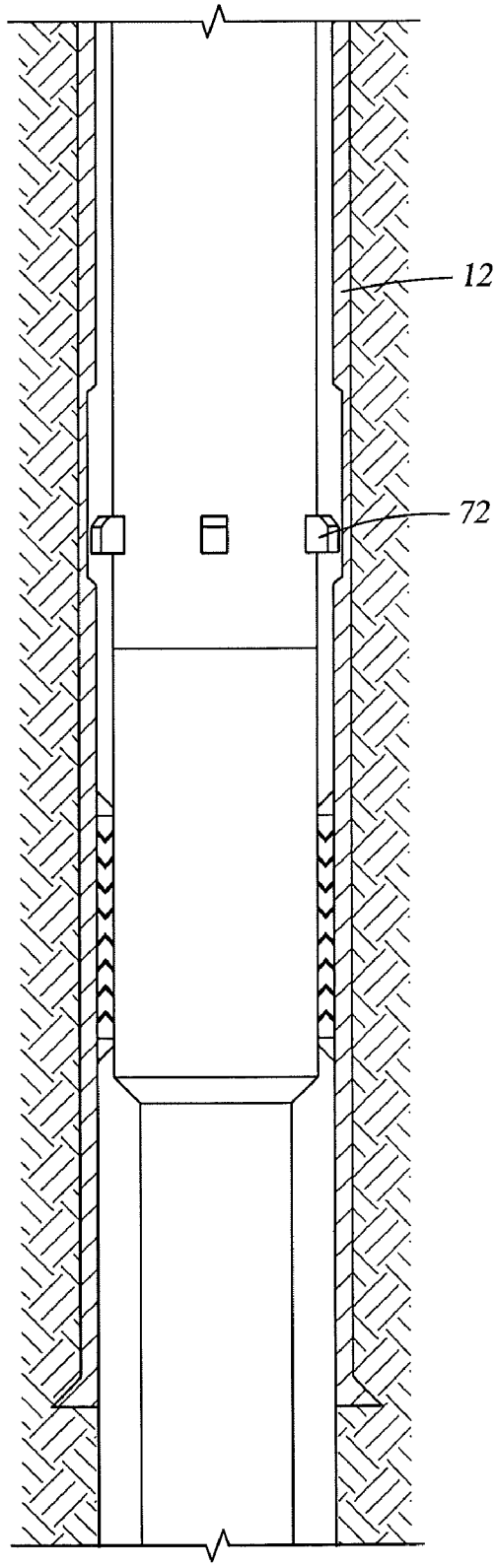
FIG. 7 is a schematic view of another embodiment of an arrangement as disclosed herein.

Referring to FIG. 7, another alternate embodiment is illustrated that eschews the uphole no go 52 in favor of a single no go 54 that is receivable in a recess 72 in the casing 12. When the one or more dogs 56 are extended into the recess 72, both uphole and downhole movement of the arrangement 26 are limited. Similar to the FIG. 6 embodiment, the length of the recess 72 should be considered relative to the designed in stroke of the seal or polished bore to ensure that the seal to the arrangement 26 remains intact during use of the arrangement. This embodiment has the added advantage that the entire arrangement 26 could be run deeper in the well if for some reason that became desirable. This is because there is no fixed uphole no go 52 that would get hung if such running was attempted with the embodiments of FIGS. 2-6.

Figure 8:
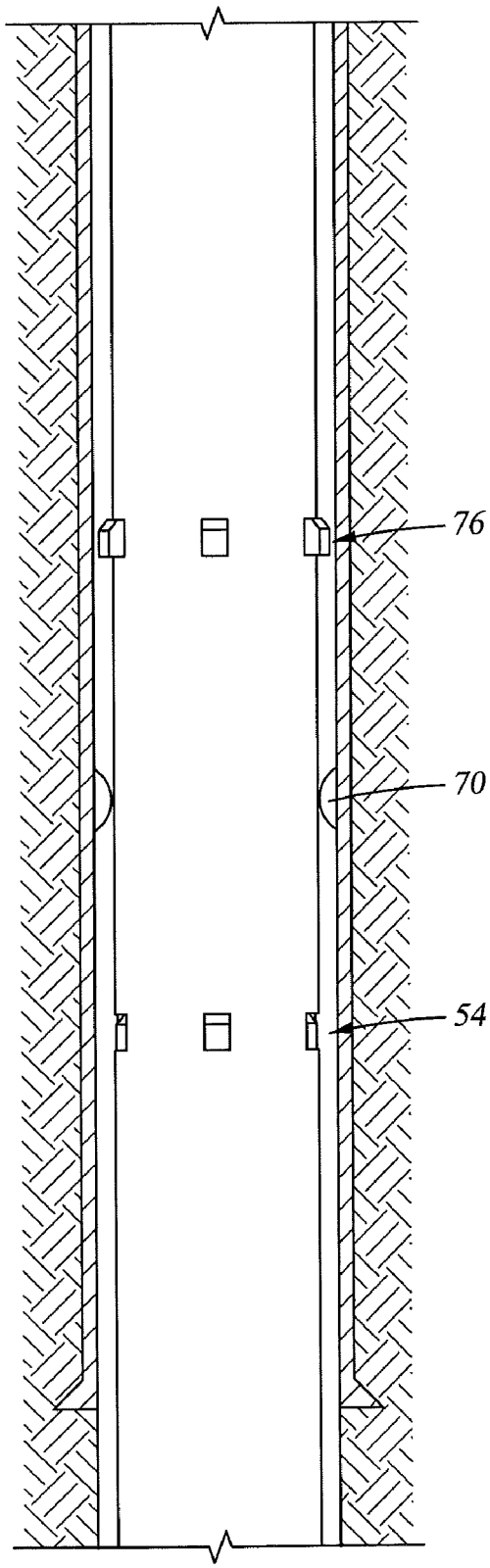
FIG. 8 is a schematic view of another embodiment of an arrangement as disclosed herein.

Referring to FIG. 8, an embodiment similar to FIG. 6 is illustrated. In fact the only difference between the embodiment of FIG. 8 and that of FIG. 6 is the addition of another retractable and extendible no go 76. This no go may be configured, in one embodiment, as is no go 54 identified above. As in the benefit of FIG. 7, the embodiment of FIG. 8 can also be run deeper than the intended depth of the arrangement as there is no fixed no go to hang up.

Figure 9:
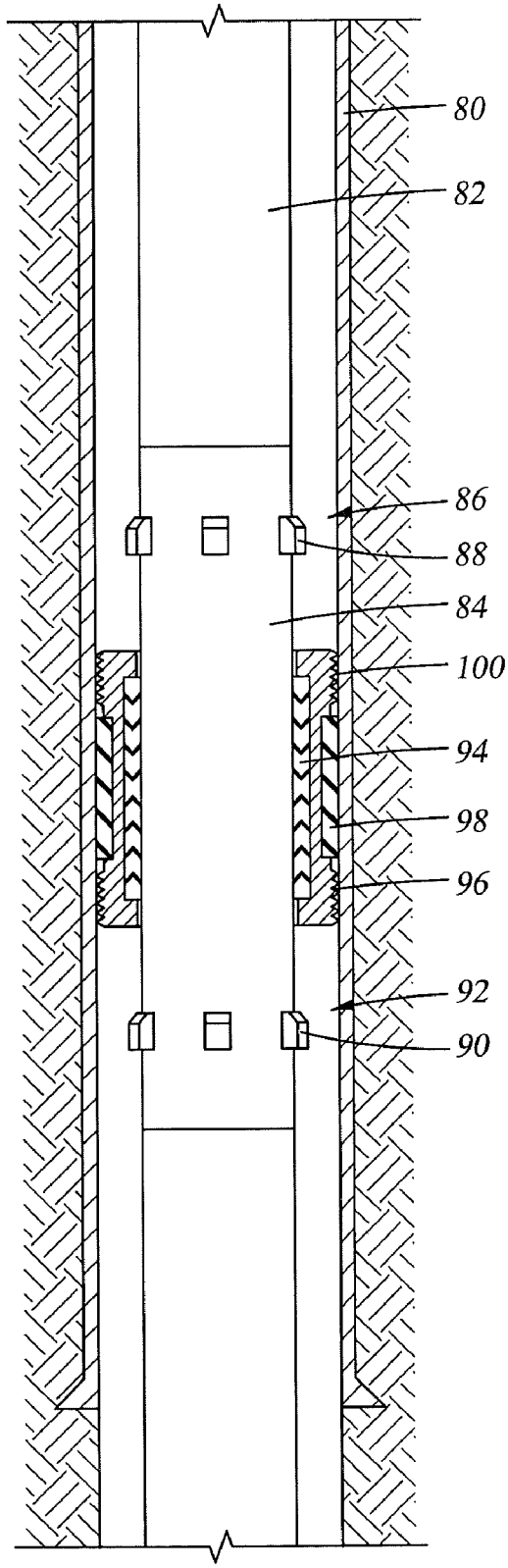
FIG. 9 is a schematic view of another embodiment of an arrangement as disclosed herein

Referring to FIG. 9, yet another embodiment of the arrangement broadly disclosed herein is illustrated. In this embodiment, a single trip system, even in a preexisting well completion, is enabled. A casing 80 is illustrated which may be a new casing or a preexisting casing or in fact may signify a wall of an open hole as it is possible to install this system in an open hole as well as a cased hole. A liner 82 is illustrated having a strokable liner hanger 84 engaged therewith. The liner hanger 84 includes no gos 86 at an uphole end 88 of liner hanger 84 and no gos 90 at a downhole end 92 of liner hanger 84. These no gos may be configured as nonmovable types, deployable only types, retractable only types or extendible and retractable types as conditions dictate. The distinctions among these and needs for specific ones of these should be appreciated from the foregoing disclosure of other embodiments of the invention but for efficiency in reading this application it is noted that fixed no gos at the uphole end of liner hanger 84 do not allow motion farther downhole but allow retrieval of the hanger without the other components of this embodiment; retractable no gos at the uphole end allow additional downhole motion; retractable no gos at the downhole end allow retrieval of the hanger without the other components of this embodiment and retractable no gos on both ends allow the retrieval or farther downhole motion discussed. It will be understood that the spacing of the no gos dictates the actual stroke capability of the strokable liner hanger 84. Extendable no gos avoid gage problems in other locations of the well.

Outwardly adjacent the liner hanger 84 are, in radially increasing sequential order, a slide seal 94, casing seal sub 96, a fixed seal 98 and slips 100. These are all mounted to the liner hanger 84 in a selectively releasable manner such as by one or more shear screws, etc. The casing seal sub is settable against the casing 80 or open hole by set down weight as in a mechanically set packer as will be well understood by one of skill in the art or may be settable by hydraulic pressure in known ways. The slips 100 bite into the casing 80 or open hole and the fixed seal 98 forms a pressure tight connection with the casing 80 or open hole. This secures the noted components in place at the casing 80. The liner hanger 84 may then move relative to the casing seal sub While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A strokable liner hanger arrangement comprising:
a liner hanger;
one of a slide seal and a casing seal sub disposed as a part of the liner hanger;
the other of the slide seal and the casing seal sub disposed adjacent the one of the slide seal and the casing seal sub; and,
a slip disposed on the casing seal sub;
wherein the casing seal sub is fixed to the liner hanger in a first condition, and released from the liner hanger in a second condition, and the liner hanger is strokable with respect to the casing seal sub in the second condition in response to thermal expansion of a liner supported by the liner hanger.

2. The strokable liner hanger arrangement as claimed in claim 1 further comprising:
a fixed seal, wherein the slide seal and the casing seal sub are disposed between the liner hanger and the fixed seal, and the fixed seal is arranged to form a pressure tight connection with a casing or open hole, the liner hanger strokable relative to the casing seal sub when the fixed seal forms the pressure tight connection.

3. The strokable liner hanger arrangement as claimed in claim 2 wherein the slide seal, casing seal sub, and fixed seal are outwardly adjacent the liner hanger in radially increasing sequential order in a cross-section taken substantially perpendicular to a longitudinal axis of the liner hanger arrangement.

4. The strokable liner hanger arrangement as claimed in claim 1, wherein the casing seal sub is fixed to the liner hanger by a shear screw in the first condition.

5. The strokable liner hanger arrangement as claimed in claim 1, further comprising a no go.

6. The strokable liner hanger arrangement as claimed in claim 5 wherein the no go is extendible.

7. The strokable liner hanger arrangement as claimed in claim 5 wherein the no go is retractable.

8. The strokable liner hanger arrangement as claimed in claim 5 wherein the no go is at a downhole end of the liner hanger.

9. The strokable liner hanger arrangement as claimed in claim 5 wherein the no go is at an uphole end of the liner hanger.

10. The strokable liner hanger arrangement as claimed in claim 1 wherein the arrangement further includes both an uphole no go and a downhole no go.

11. The strokable liner hanger arrangement as claimed in claim 10 wherein at least one of the uphole no go and the downhole no go is a retractable and extendible no go.

12. A method for completing a wellbore with a strokable liner hanger arrangement comprising:

running a liner hanger having one of a slide seal and a casing seal sub disposed as a part of the liner hanger, the other of the slide seal and the casing seal sub disposed adjacent the one of the slide seal and the casing seal sub to a target depth in a casing or open hole while the casing seal sub is mounted to the liner hanger;

engaging the liner hanger with the casing or open hole by setting the casing seal sub against the casing or open hole and forming a pressure tight connection with the casing or open hole with a fixed seal that is outwardly adjacent the casing seal sub; and, releasing the casing seal sub from the liner hanger, allowing the liner hanger to move relative to the casing seal sub while set against the casing or open hole by the fixed seal.

13. The method as claimed in claim 12 wherein the engaging includes actuating at least one slip disposed adjacent the other of the slide seal and the casing seal sub into contact with the casing or open hole.

14. The method as claimed in claim 12 wherein the method further includes extending one or more no gos.

15. The method as claimed in claim 12 wherein the method further includes retracting one or more no gos.

* * * * *